United States Patent [19]

Lozar et al.

[11] 4,118,708

[45] Oct. 3, 1978

[54] TELESCOPIC AERIAL WITH FRICTION RETAINING SLEEVES

[75] Inventors: Giorgio Lozar; Renato Favale, both of Turin, Italy

[73] Assignee: Indesit Industria Elettrodomestici Italiana S.p.A., Rivalta (Turin), Italy

[21] Appl. No.: 801,979

[22] Filed: May 31, 1977

[30] Foreign Application Priority Data

Jun. 9, 1976 [IT] Italy ..... 68397 A/76

[51] Int. Cl.[2] ..... H01Q 1/10

[52] U.S. Cl. ..... 343/901; 343/889

[58] Field of Search ..... 343/711-715, 343/749, 750, 883, 889, 901-903; 52/110, 118

[56] References Cited

U.S. PATENT DOCUMENTS

| | | | |
|---|---|---|---|
| 2,391,202 | 12/1945 | Tellander et al. | 343/903 |
| 2,677,973 | 5/1954 | Gosline | 343/903 |

*Primary Examiner*—Alfred E. Smith
*Assistant Examiner*—David K. Moore
*Attorney, Agent, or Firm*—Sughrue, Rothwell, Mion, Zinn and Macpeak

[57] ABSTRACT

A telescopic aerial for a radio or television receiver is constructed to facilitate automatic assembly and comprises a plurality of tubular aerial elements surrounding a central stem, the elements are slidable within one another and each has an enlarged lower end, which is housed within the next outermost element, and a radially inwardly directed lip at the upper end. Between each pair of adjacent elements is a freely slidable axially split spring sleeve which frictionally engages the two tubular elements to prevent them from slipping with respect to one another. The enlarged lower ends of the tubular elements are also formed with inwardly bent tabs to limit the inward movement of the next innermost element when the aerial is collapsed.

1 Claim, 5 Drawing Figures

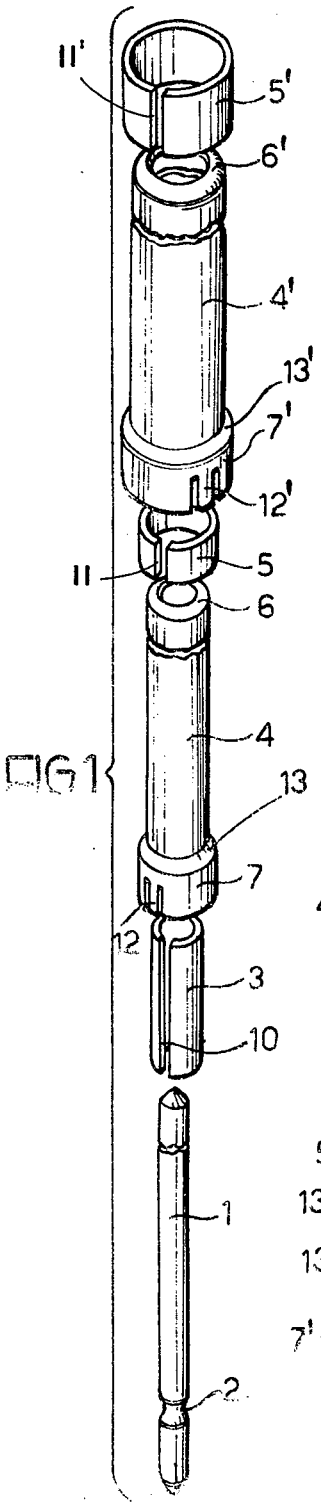
FIG 1
FIG. 3
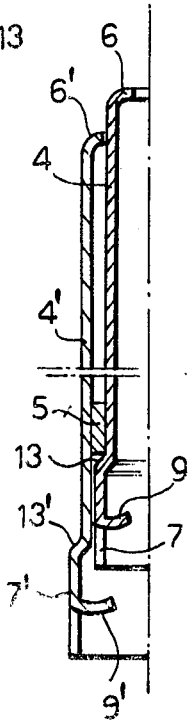
FIG. 4
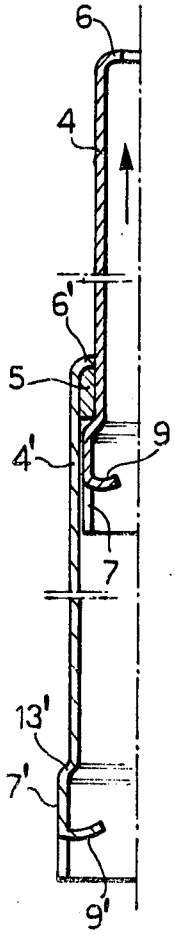
FIG. 5
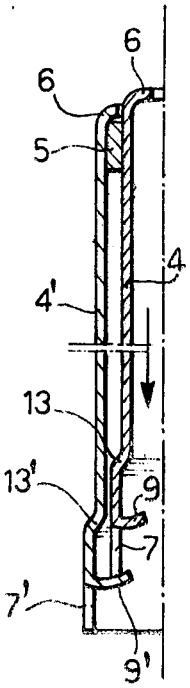

TELESCOPIC AERIAL WITH FRICTION RETAINING SLEEVES

The present invention relates to a telescopic aerial and particularly to such an aerial which is suitable for a portable radio or television receiver.

Telescopic aerials for portable television or radio receivers are usually formed by a series of chromium plated brass tubes, having a wall thickness in the region of, for example, 0.25mm and of successively smaller diameters ranging from, for example, 6 millimeters down to 2 millimeters. The tubes must be sufficiently free to slide into one another when caused to do so by a force applied manually, but must engage with one another frictionally sufficient to prevent them from slipping in either direction.

The frictional engagement is usually achieved by means of springs made of hard brass or phosphor bronze, of a thickness in the region of 0.1mm, and shaped in the form of cylindrical sections, with deep dimples which engage in holes provided adjacent the ends of the tubes. These springs, apart from not being easy to manufacture, require very careful and critical manual installation when the aerial is being assembled. Above all, the centering of the dimple of the spring in relation to the hole adjacent the end of the tube is very difficult for the operator and makes it practically impossible to assemble the tubes in an automatic machine.

French Pat. No. 1,404,618 discloses and describes a telescopic aerial comprising a central cylindrical stem having a number of cylindrical tubular elements of successively greater diameters coaxially mounted thereon. Between the central stem and the adjacent coaxial tubular element is located a longitudinally split spring sleeve acting as a friction element which is fixed to the base of the central stem. A similar longitudinally split spring sleeve is interposed between each tubular element and the adjacent tubular element which surrounds it, the sleeve being connected to the inner of the two tubular elements between which it is positioned by means of a fastening in such a manner that the split sleeve moves with the tubular element which it surrounds; each tubular element is provided at its upper, outer end with an inwardly directed lip forming an abutment stop against which the split spring sleeve of the adjacent tubular element within it abuts when it has been drawn out telescopically to its greatest extent.

The attachment of the spring sleeve to each tubular element is an operation in the production process of the aerial which is difficult to perform in view of the very small thickness and the narrow diameter of the tubular elements of the aerial. Moreover, aerials made according to French Pat. No. 1,404,618 require the use of further independent means to prevent the telescopically slidable elements from being pushed too far inwards with respect to the adjacent surrounding tubular element.

The technical problem which the present invention seeks to solve is to provide a telescopic aerial which does not have the above-mentioned disadvantages of prior art aerials, which is formed of simple elements, and which can be assembled entirely by machine.

According to the present invention a telescopic aerial, comprising a central cylindrical stem, a plurality of cylindrical tubular elements of successively larger diameters coaxially surrounding the stem, such that one end of the central stem and one end of each of the tubular elements is slidably located within the immediately surrounding tubular element with the other end projecting at least partly therefrom, a longitudinally split sleeve carried at or adjacent the said one end of the central stem and located between the central stem and the immediately surrounding tubular element, a plurality of further split sleeves, each interposed between a respective tubular element and the tubular element which surrounds it, each of the split sleeves serving to frictionally engage the two tubular elements between which it is located, each tubular element having at its other end an annular radially inwardly directed lip forming an abutment stop against which engages the split sleeve located between this tubular element and the adjacent element within it when the said adjacent element is extended to its maximum extent, is charcterised in that each tubular element has at its said one end, a part of greater diameter than the main part of the tubular element and linked to the said main part by an annular shoulder, and that in each split sleeve interposed between two tubular elements is freely slidable with respect to each of the two tubular elements, such that when each tubular element of the aerial has been extended to its maximum extent it is prevented from further extension by the abutment of its annular shoulder against one end of the split sleeve which surrounds it and the abutment of this split sleeve against the inwardly directed lip of the adjacent surrounding tubular element.

In a preferred embodiment of the invention the end part of greater diameter of each tubular element has at least one tap projecting radially inwardly to form an abutment stop against which engages the said one end of the adjacent element within it when the said adjacent element is retracted fully into the said element.

By this means aerials formed as embodiments of the present invention are held together so that the elements of which they consist are prevented both from slipping out from one another and from slipping too far into one another.

The present invention also comprehends a process for the manufacture of a telescopic aerial comprising a central cylindrical stem, a plurality of cylindrical tubular elements of successively larger diameters coaxially surrounding the stem, a longitudinally split sleeve carried at or adjacent the said one end of the central stem and located between the central stem and the immediately surrounding tubular elements, a plurality of further split sleeves each interposed between a respective tubular element and the tubular element which surrounds it, each of the split sleeves serving to frictionally engage the two tubular elements between which it is located, each tubular element having at its other end an annular radially inwardly directed lip forming an abutment stop against which engages the split sleeve located between this tubular element and the adjacent element within it when the said adjacent element is extended to its maximum extent, in which each tubular element has as its said one end, a part of greater diameter than the main part by an annular shoulder, in which each split sleeve interposed between two tubular elements is freely slidable with respect to each of the two tubular elements, such that when each tubular element of the aerial has been extended to its maximum extent it is prevented from further extension by the abutment of its annular shoulder against one end of the split sleeve which surrounds it and the abutment of this split sleeve against the inwardly directed lip of the adjacent surrounding tubular element and in which the end part of greater diameter of each tubular element has at least one tab projecting radially inwardly to form an abutment stop against which engages the said one end of the adjacent element within it when the said adjacent element is retracted fully into the said element, which includes the steps of punching the said end parts of larger diameter of each of the said tubular elements before assembly, to form axial tongues, and after each tubular element has been assembled to the parts of the aerial which are to be located within it, inwardly bending the axial tongues to form the said radially inwardly projecting tabs.

One embodiment of the present invention will now be more particularly described, by way of example, with reference to the accompanying drawings, in which:

FIG. 1 is an exploded view illustrating in perspective the elements of which a telescopic aerial constructed according to the present invention is formed;

FIG. 3 is a detail on an enlarged scale, of a part of FIG. 2G; and

FIGS. 4 and 5 illustrate the elements of FIG. 3 in the two end positions which the elements can adopt.

Figure 2:
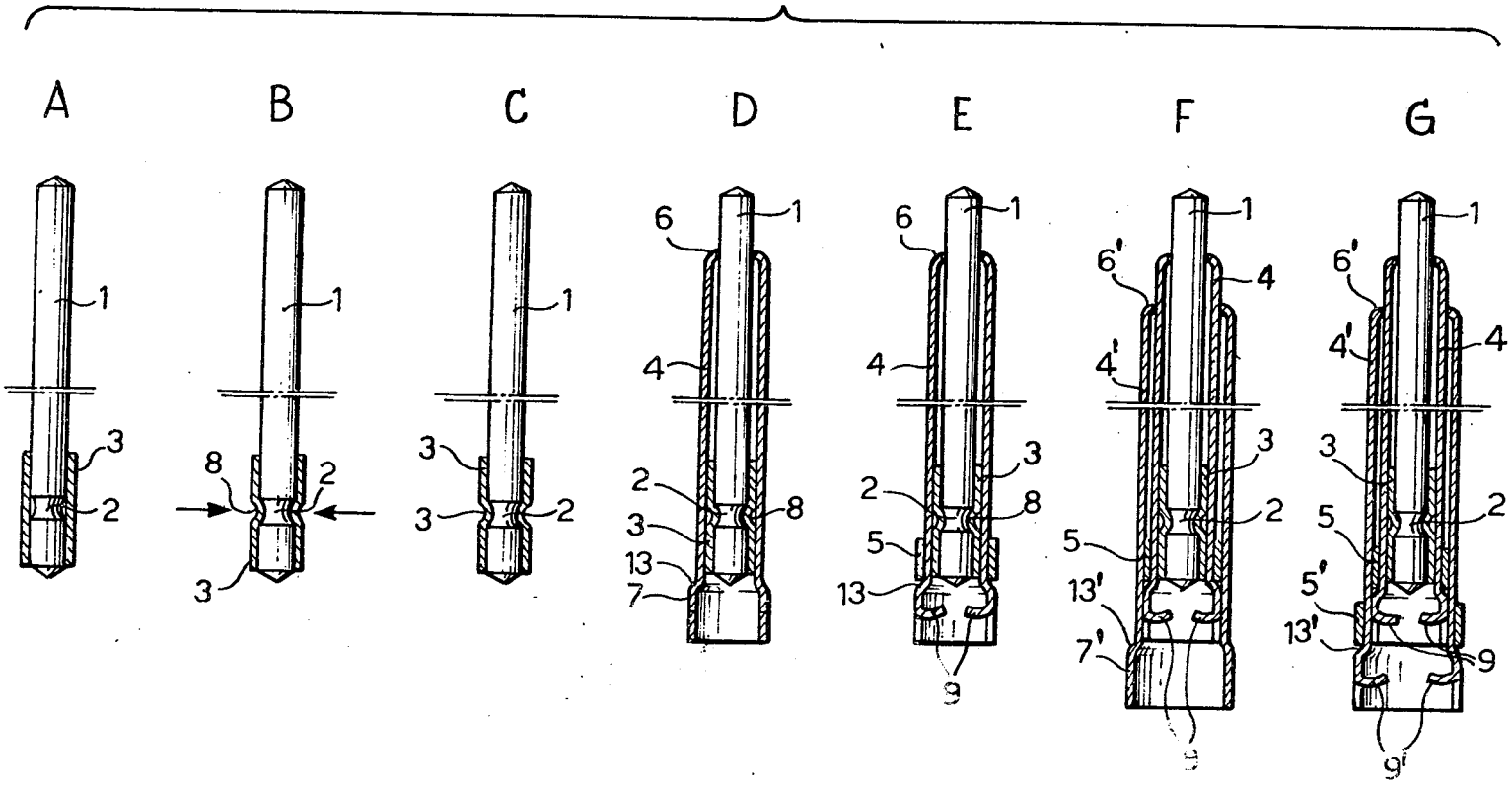
FIG. 2 is a set of axial sections illustrating the successive stages, indicated A, B, C, D, E, F, G, in the assembly of the elements forming a telescopic aerial formed as an embodiment of the invention.

Referring now to the drawings there are shown, in FIG. 1, the basic components of a telescopic aerial formed as an embodiment of the present invention, before being assembled together. These components comprise:

a cylindrical stem 1 of solid rod and having a circumferential groove 2 adjacent one end thereof;

a cylindrical sleeve 3 having an axial slit 10, and made of phosphor bronze or solid brass;

a plurality of tubular elements 4,4' having successively larger diameters in relation to one another in steps of 1mm; and a plurality of further cylindrical sleeves 5,5' each having an axial slit 11, 11' and each being made of phosphor bronze or solid brass; the further split sleeves are shorter than the cylindrical sleeve 3 which surrounds the central rod 1.

The tubular elements 4,4' are provided with a section 7,7' of greater diameter at one end which, in normal use, will be their lower end, connected to the main part by a substantially radial annular surface forming a shoulder 13, 13' and each have an annular inwardly projecting lip 6,6' at the other end which in normal use will be the upper end. In the enlarged sections 7,7' at the said one end there are formed, such as by punching, two tongues respectively indicated 12, 12': the tongues 12, 12' are preferably but not necessarily, diametrically opposite one another.

A telescopic aerial may consist, for example, of a stem 1 and five tubular elements of successively greater diameter, which are fitted into one another.

FIG. 2 illustrates the various stages involved in assembling the individual elements together, and the various operations which are performed on the elements in order to fix them together in such a way that the finished aerial will satisfy the functional requirements. FIG. 2A illustrates the first stage of assembly in which the split spring sleeve 3 is fitted onto the stem 1. In FIG. 2B is shown the second stage of assembly in which the split sleeve 3 is punched or pressed by two diametrically opposed tools indicated by the two arrows of FIG. 2 aligned with the groove 2 in the stem 1, so as to create two embossed dimples 8 which project into the groove 2 of the stem 1 in order to prevent the sleeve 3 from sliding with respect to the stem 1. FIG. 2C illustrates the form of the split sleeve 3 after the punching operation.

FIG. 2D illustrates the third assembly stage in which the stem 1 carrying the split sleeve 3 is inserted into a first, or innermost, tubular element 4. The stem 1 is prevented from being pushed through the upper end of the tubular element 4 by the split sleeve 3, should the stem 1 be inserted too far because the sleeve 3, being solidly joined to the stem 1 by means of the embossed dimples 8, abuts against the inwardly turned rim 6 of the tubular element 4 when the stem reaches its uppermost position. After insertion of the stem 1 into the tubular element 4 the two tongues 12 at the lower end of the tubular element 4 are bent inwardly, that is towards one another, in such a way as to form two radially inwardly projecting tabs 9, which prevent the stem 1 from being withdrawn through the lower end of the tubular element 4. At the same time as the stem 1 is being inserted into the tubular element 4 from the lower end thereof, a split sleeve 5 is being fitted over the tubular element 4 from the upper end thereof, as shown in FIG. 2E.

The next stage in the assembly, comprises the insertion of the assembly formed so far into the lower end of a further tubular element 4'. Following this, as shown in FIG. 2G, the two tongues 12' of the tubular element 4' are folded inwardly like the tongues 12 of the tubular element 4, to form radially inwardly projecting tabs 9'. This stage of assembly also includes the fitting of a further split sleeve 5' over the tubular element 4'.

This process continues with further tubular elements 4'', 4''' and further split sleeves 5'', 5''' etc. until the required number of components have been fitted together. It should be noted that because of the axial slit in the sleeves 5, 5' etc. these tend to open up because of their intrinsic elasticity, and, therefore, when inserting one tubular element into another, it is necessary to hold the sleeve on the inner tubular element clamped so that its outer diameter is less than the inner diameter of the outer tubular element, by means of a suitable tool.

The split sleeves 5, 5' etc. serve to frictionally engage between adjacent tubular elements so that when the aerial has been extended it does not slip back under gravity, they also serve to ensure electrical contact between adjacent tubular elements and also, to prevent the tubular elements from being pulled out from one another upon extension of the aerial to its maximum extent. This is achieved by the split sleeve abutting the radially inwardly directed lip 6 at the upper end of the tubular element which surrounds it, and the shoulder formed by the substantially radial surface 13 separating the main portion of the tubular element from the enlarged section at the lower end thereof. The tabs 9,9' as mentioned above, prevent the tubular elements from being pushed out through the lower end of the immediately surrounding tubular element when the aerial is being collapsed. In fact, the enlarged portion 7 of a tubular element 4, by contacting the tab 9' of the enlarged section 7' of the immediately surrounding tubular element 4' transfers the applied collapsing force thereto so that the element 4' is displaced with the element 4 once the latter has been pushed into its maximum extent.

The advantages of embodiments of the present invention reside in the simplicity of the elements of which they are formed, in the ease of assembling these elements together to form a telescopic aerial, in the fact that the whole assembly process can be automated and in the better way in which the parts of the aerial are held together upon collapsing due to the fact that this no longer dependent on small indentations provided in the sleeves as in the prior art, but by the bent over tabs at the lower ends of the tubes, which are of much greater strength.

What is claimed is:

1. In a telescopic aerial comprising:

a central cylindrical stem, a plurality of cylindrical tubular elements of successively larger diameters coaxially surrounding said stem, and positioned such that one end of said central stem and one end of each of said tubular elements is slidably located within the immediately surrounding tubular element with the other and projecting at least partly therefrom, a longitudinally split resilient sleeve carried at or adjacent said one end of said central stem and located between said central stem and the immediately surrounding tubular element, a plurality of further split resilient sleeves each interposed between a respective tubular element and the tubular element which surrounds it, each of said further split sleeves frictionally engaging the two tubular elements between which it is located, an annular radially inwardly directed lip on said other end of each tubular element, each said annular radially inwardly directed lip forming an abutment stop against which engages the split sleeve located between said tubular element and the adjacent element within it when said adjacent element is extended to its maximum extent, the improvement wherein:

each said tubular element has at its said one end, a part of greater diameter than the main part of said tubular element, said end part having at least one tab which is of one-piece with said end part projecting radially inwardly to form an abutment stop, said one end of the adjacent element within said tubular element abutting against said at least one tab when the said adjacent element is retracted fully into said tubular element.

an annular shoulder joining said end part of greater diameter to said main part of said tubular element, and each split sleeve interposed between two tubular elements being freely slidable with respect to each of said two tubular elements between which it is interposed whereby, when each said tubular element of the aerial has been extended to its maximum extent it is prevented from further extension by the abutment of its annular shoulder against one end of the split sleeve which surrounds it and the abutment of this split sleeve against said inwardly directed lip of the adjacent surrounding tubular element.

* * * * *